United States Patent [19]

Cha

[11] 4,089,375

[45] May 16, 1978

[54] IN SITU RETORTING WITH WATER VAPORIZED IN SITU

[75] Inventor: Chang Yul Cha, Bakersfield, Calif.

[73] Assignee: Occidental Oil Shale, Inc., Grand Junction, Colo.

[21] Appl. No.: 796,696

[22] Filed: May 13, 1977

Related U.S. Application Data

[63] Continuation-in-part of Ser. No. 728,911, Oct. 4, 1976, abandoned, and Ser. No. 615,558, Sep. 22, 1975, Pat. No. 4,036,299, which is a continuation-in-part of Ser. No. 492,289, Jul. 26, 1974, abandoned, said Ser. No. 728,911, is a continuation-in-part of Ser. No. 648,358, Jan. 12, 1976, abandoned, which is a continuation of Ser. No. 465,097, Apr. 29, 1974, abandoned.

[51] Int. Cl.[2] ..... E21B 43/24; E21B 43/26

[52] U.S. Cl. ..... 166/261; 166/259; 299/2; 299/3

[58] Field of Search ..... 166/261, 259, 260, 256, 166/272, 247; 299/2–4

[56] References Cited

U.S. PATENT DOCUMENTS

| | | | |
|---|---|---|---|
| 2,801,089 | 7/1957 | Scott, Jr. | 299/2 |
| 3,001,776 | 9/1961 | van Poollen | 299/2 |
| 3,113,620 | 12/1963 | Hemminger | 166/247 X |
| 3,196,945 | 7/1965 | Craig, Jr. et al. | 166/261 |
| 3,233,668 | 2/1966 | Hamilton et al. | 166/259 |
| 3,316,020 | 4/1967 | Bergstrom | 299/2 |
| 3,400,762 | 9/1968 | Peacock et al. | 166/259 |
| 3,454,958 | 7/1969 | Parker | 166/256 |
| 3,482,630 | 12/1969 | Earlougher, Jr. | 166/260 |
| 3,521,709 | 7/1970 | Needham | 166/259 X |
| 3,533,469 | 10/1970 | Parker | 166/247 X |
| 3,548,938 | 12/1970 | Parker | 166/256 |
| 3,577,338 | 5/1971 | Gifford | 208/11 |
| 3,586,377 | 6/1971 | Ellington | 299/2 X |
| 3,593,789 | 7/1971 | Prats | 166/261 X |
| 3,596,993 | 8/1971 | Busey | 166/261 X |
| 3,601,193 | 8/1971 | Grady | 166/247 X |
| 3,605,890 | 9/1971 | Holm | 166/271 |
| 3,661,423 | 5/1972 | Garret | 299/2 |
| 3,892,270 | 7/1975 | Lindquist | 166/261 X |

*Primary Examiner*—Stephen J. Novosad
*Attorney, Agent, or Firm*—Christie, Parker & Hale

[57] ABSTRACT

A combustion zone is advanced through an in situ oil shale retort containing a fragmented permeable mass of oil shale particles by introducing into the retort on the trailing side of the combustion zone: water, at least sufficient fuel to vaporize the water, and sufficient oxygen to oxidize the fuel for vaporizing the water and to form a gaseous combustion zone feed containing water vapor and oxygen. The gaseous combustion zone feed is for introduction into the combustion zone to advance the combustion zone through the fragmented mass of particles and produce combustion gas in the combustion zone.

37 Claims, 1 Drawing Figure

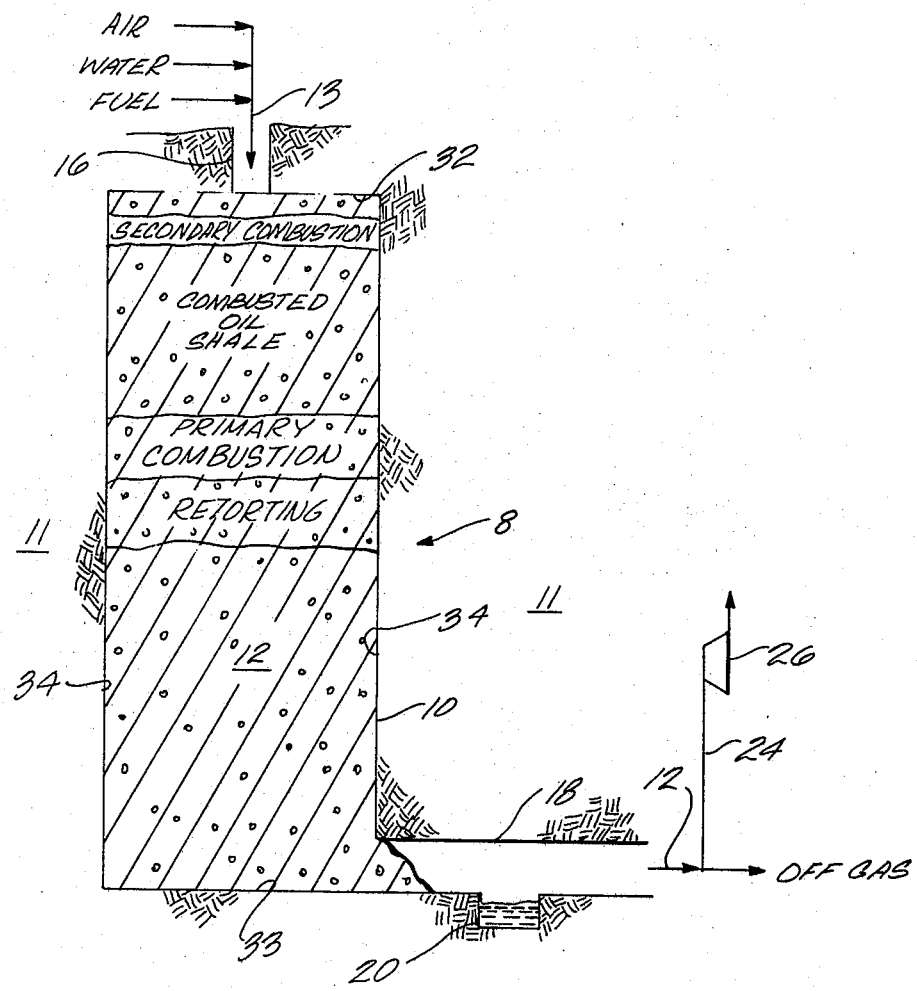
AIR
WATER
FUEL
13
16
32
SECONDARY COMBUSTION
COMBUSTED OIL SHALE
PRIMARY COMBUSTION
RETORTING
11
8
11
34
12
34
10
26
24
12
18
OFF GAS
33
20

IN SITU RETORTING WITH WATER VAPORIZED IN SITU

CROSS-REFERENCES

This application is a continuation-in-part of application Ser. No. 728,911 filed on Oct. 4, 1976, now abandoned which is a continuation-in-part of application Ser. No. 648,358 filed Jan. 12, 1976, now abandoned, which is a continuation of application Ser. No. 465,097, filed Apr. 29, 1974, now abandoned. This application is also a continuation-in-part of U.S. Pat. application Ser. No. 615,558 filed Sept. 22, 1975, and now U.S. Pat. 4,036,299 which is a continuation-in-part of application Ser. No. 492,289, filed July 26, 1974, and now abandoned. All five of these applications are incorporated herein by this reference.

BACKGROUND OF THE INVENTION

The presence of large deposits of oil shale in the Rocky Mountain region of the United States has given rise to extensive efforts to develop methods of recovering shale oil from kerogen in the oil shale deposits. It should be noted that the term "oil shale" as used in the industry is in fact a misnomer; it is neither shale nor does it contain oil. It is a sedimentary formation comprising marlstone deposit with layers containing an organic polymer called "kerogen," which upon heating decomposes to produce liquid and gaseous products. It is the formation containing kerogen that is called "oil shale" herein, and the liquid hydrocarbon product is called "shale oil." A number of methods have been proposed for processing the oil shale which involve either first mining the kerogen bearing shale and processing the shale on the surface, or processing the shale in situ. The latter approach is preferably from the standpoint of environmental inpact since the spent shale remains in place, reducing the chance of surface contamination and the requirement for disposal of solid wastes.

The recovery of liquid and gaseous products from oil shale deposits has been described in several patents, one of which is U.S. Pat. No. 3,661,423, issued May 9, 1972, to Donald E. Garrett, assigned to the assignee of this application and incorporated herein by reference. This patent describes in situ recovery of liquid and gaseous hydrocarbon materials from a subterranean formation containing oil shale by fragmenting such formation to form a stationary, fragmented permeable body or mass of formation particles containing oil shale within the formation, referred to herein as an in situ oil shale retort. Hot retorting gases are passed through the in situ oil shale retort to convert kerogen contained in the oil shale to liquid and gaseous products, thereby producing "retorted oil shale."

One method of supplying hot retorting gases used for converting kerogen contained in the oil shale, as described in U.S. Pat. No. 3,661,423, includes establishment of a combustion zone in the retort and introduction of an oxygen containing retort inlet mixture downwardly into the retort as a gaseous combustion zone feed to advance the combustion zone downwardly through the retort. In the combustion zone oxygen in the combustion zone feed is depleted by reaction with hot carbonaceous materials to produce heat and combustion gas. By the continued introduction of the retort inlet mixture downwardly into the retort, the combustion zone is advanced downwardly through the retort.

The combustion gas and the portion of the combustion zone feed that does not take part in the combustion process pass through the fragmented mass in the retort on the advancing side of the combustion zone to heat the oil shale in a retorting zone to a temperature sufficient to produce kerogen decomposition, called retorting, in the oil shale to gaseous and liquid products including gaseous and liquid hydrocarbon products and to a residual solid carbonaceous material.

The liquid products and gaseous products are cooled by the cooler oil shale fragments in the retort on the advancing side of the retorting zone. The liquid hydrocarbon products, together with water produced in or added to the retort, are collected at the bottom of the retort. An off gas containing combustion gas generated in the combustion zone, gaseous products produced in the retorting zone, gas from carbonate decomposition, and any gaseous retort inlet mixture that does not take part in the combustion process is also withdrawn from the bottom of the retort. The products of retorting are referred to herein as liquid and gaseous products.

The residual carbonaceous material in the retorted oil shale can be used as fuel for advancing the combustion zone through the retorted oil shale. When the residual carbonaceous material is heated to combustion temperature it reacts with oxygen. The portion of the retort where the greater part of the oxygen in the retort inlet mixture that reacts with residual carbonaceous material in retorted oil shale is consumed is called the primary combustion zone. It is characterized by a temperature which is higher than in other parts of the retort. As the residual carbonaceous material becomes depleted in the combustion process, the oxygen penetrates farther into the oil shale retort where it combines with remaining unoxidized residual carbonaceous material, thereby causing the combustion zone to advance through the fragmented oil shale.

The rate of retorting of the oil shale to liquid and gaseous products is temperature dependent, with relatively slow retorting occurring at 600° F, and relatively rapid retorting of the kerogen in oil shale occurring at 950° F and higher temperatures. As the retorting of a segment of the fragmented oil shale in the retorting zone progresses and less heat is extracted from the gases passing through the segment, the combustion gas heats the oil shale farther on the advancing side of the combustion zone to retorting temperatures, thus advancing the retorting zone on the advancing side of the combustion zone.

Water withdrawn from the in situ retort with the shale oil can contain dissolved or suspended hydrocarbons. Water is gravity separated from the shale oil product and can contain up to 1% of hydrocarbons. The presence of oil in the water renders it useless for many applications without costly purification.

It can be desirable to limit the oxygen content of the combustion zone feed to about 15%. At oxygen concentrations higher than about 15%, high primary combustion zone temperatures resulting in fusion of the oil shale can occur if a high volumetric flow rate of combustion zone feed is provided. Thus to reduce the oxygen content of air, which is presently the most economical source of oxygen, the air can be diluted with a portion of off gas generated by retorting of oil shale. However, it has been found that when recycled off gas is used to dilute the air, the off gas from the retort can have a fuel value of only about 45 BTU/SCF (British thermal units per standard cubic foot), which can be insufficient to power a work engine.

When off gas recycling is used to dilute air, a narrow combustion zone is generated. With off gas recycling, it is calculated that for a combustion zone having a maximum temperature of 1400° F, the thickness of a primary combustion zone having a temperature of 1300° F on its leading edge and a temperature of 900° F on its trailing edge can be about 0.8 foot. With such a narrow primary combustion zone, oxygen from the primary combustion zone can oxidize hydrocarbon products produced in the retorting zone, thereby lowering the hydrocarbon yield from the retort. In addition, cracking of hydrocarbon products can occur if exposed to excessively high temperatures.

A combustion zone feed can be formed by diluting air with steam generated in a steam plant; however, operating and capital costs for a steam plant are high. Attempts to eliminate the steam plant by generating the steam in situ by introducing water into an in situ oil shale retort on the trailing side of the combustion zone have resulted in comsumption of significant quantities of water, possibly due to water absorption by retorted oil shale. Retorted oil shale is substantially more porous than raw oil shale. For every gallon of water released by raw oil shale during retorting, about 6 pounds of water can be absorbed by retorted oil shale. Since water is a valuable and limited commodity in the western portion of the United States, generating steam in situ by introducing water into a retort on the trailing side of the combustion zone is not considered satisfactory.

Thus, it is desirable to provide a method for recovering liquid and gaseous products from an in situ oil shale retort which yields off gas of sufficient fuel value to operate a work engine, which gives high recovery of product, does not require a costly steam plant, and does not consume significant quantities of water.

SUMMARY OF THE INVENTION

In a method of this invention a combustion zone is advanced through an in situ oil retort in a subterranean formation containing oil shale. The retort contains a fragmented permeable mass of formation particles containing oil shale. The combustion zone is advanced through the retort by introducing into the retort on the trailing side of the combustion zone a retort inlet mixture comprising liquid water, at least sufficient fuel to vaporize the water, and sufficient oxygen to oxidize the fuel for vaporizing the water and to form a gaseous combustion zone feed containing water vapor and oxygen. The gaseous combustion zone feed is introduced into the combustion zone to advance the combustion zone through the fragmented mass of particles and produce combustion gas in the combustion zone.

Liquid and gaseous products are produced in the retort by passing the combustion gas generated in the combustion zone and any unreacted portion of the combustion zone feed through a retorting zone in the fragmented mass of particles on the advancing side of the combustion zone. Heat transferred from the combustion zone to the retorting zone retorts oil shale to produce gaseous and liquid products. The liquid products and a retort off gas containing the gaseous products, combustion gas, gas from carbonate decomposition, and any gaseous unreacted portion of the retort inlet mixture are withdrawn from the retort from the advancing side of the retorting zone.

The liquid products include hydrocarbon product and water. Portions of the hydrocarbon product and/or the water can be used to supply at least a portion of the fuel and/or water of the retort inlet mixture.

Preferably, the retort inlet mixture is introduced into the retort at a sufficient rate to form gaseous combustion zone feed having a superficial volumetric flow rate of from about 0.1 to about 2 standard cubic feet per minute (SCFM) per square foot of cross-sectional area of the fragmented permeable mass being retorted, and more preferably, from about 0.5 to about 1 SCFM per square foot of cross-sectional area of the fragmented permeable mass being retorted.

At such a total combustion zone feed rate, the retort inlet mixture introduced to the retort preferably contains sufficient oxygen that the combustion zone feed contains from about 1 to about 20% oxygen, and more preferably from about 10 to about 15% oxygen by volume. Because of its ready availability, air is the preferred source of oxygen.

Preferably the retort inlet mixture contains sufficient water that the gaseous combustion zone feed contains from about 10 to about 50% water vapor by volume, and more preferably from about 20 to about 40% water vapor by volume.

Preferably, the combustion zone is maintained at a temperature greater than about 900° F, and more preferably greater than about 1100° F, to ensure fast retorting in the retorting zone, but less than about 1800° F to prevent fusion of the oil shale.

DRAWING

These and other features, aspects and advantages of the present invention will become more apparent when considered with respect to the following description, appended claims, and accompanying drawing which illustrates semi-schematically an in situ oil shale retort useful in the practice of this invention.

DESCRIPTION

An aspect of this invention concerns an improved method for recovering liquid and gaseous products from an in situ oil shale retort. Referring to the drawing, an in situ oil shale retort 8 is in the form of a cavity 10 in a subterranean formation 11 containing oil shale. The in situ retort contains a fragmented permeable mass 12 of formation particles containing oil shale. The fragmented mass can have a wide distribution of particle sizes. For example, an in situ oil shale retort in the Piceance Creek basin of Colorado prepared by explosive expansion of formation towards a void contained a fragmented permeable mass consisting of about 58% by weight particles having a weight average diameter of 2 inches, about 23% by weight particles having a weight average diameter of 8 inches, and about 19% by weight particles having a weight average diameter of 30 inches. The retort has top 32, bottom 33, and side 34 walls or boundaries of unfragmented formation. The cavity and fragmented mass of oil shale particles can be created simultaneously by blasting by any of a variety of techniques. A method of forming an in situ oil shale retort is described in the aforementioned U.S. Pat. No. 3,661,423.

In a presently preferred embodiment of a process practiced according to principles of this invention, a retort inlet or feed mixture 13 containing liquid water, fuel and a source of oxygen such as air is introduced downwardly through a conduit 16 into the retort on the trailing side 15 of a primary combustion zone advancing through the fragmented mass in the retort. As described in greater detail hereinafter, a gaseous combustion zone feed is formed by oxidation of the fuel and resultant vaporization of the water in the retort inlet mixture in a secondary combustion zone. The gaseous combustion zone feed passes downwardly into the primary combustion zone where hot combustion gas is produced. The combustion gas and any unreacted portion of the retort inlet mixture pass from the advancing side of the combustion zone downwardly through a retorting zone in which gaseous and liquid products are produced by retorting oil shale.

The liquid and gaseous products flow downwardly through the mass 12 of formation particles on the advancing side of the retorting zone into a drift, adit, tunnel 18, or the like, in communication with the bottom of the retort. The drift contains a sump 20 in which liquid products including shale oil and water are collected and from which liquid products are withdrawn through conduit means, not shown. A retort off gas 22 containing gaseous products, combustion gas, carbon dioxide from carbonate decomposition, and any gaseous unreacted portion of the retort inlet mixture is also withdrawn by way of the drift. A portion of the retort off gas can be conveyed by line 24 for combustion in a work engine such as a gas turbine 26.

Above the primary combustion zone, there is a zone of combusted oil shale, at least part of which has an elevated temperature due to the passage of the primary combustion zone therethrough. As used herein, the term "combusted oil shale" refers to oil shale through which a primary combustion zone has passed. As used herein, the term "retorted oil shale" refers to oil shale heated to a sufficient temperature to decompose kerogen in an environment substantially free of free oxygen so as to produce liquid and gaseous products and leave a solid carbonaceous residue. An individual particle containing oil shale can have a core of retorted oil shale and an outer "shell" of combusted oil shale. Such can occur when oxygen has diffused only part way through the particle during the time it is at an elevated temperature and in contact with an oxygen supplying gas. As used herein, the term "raw oil shale" refers to oil shale which has not been subjected to processing for decomposing kerogen in the oil shale.

To initiate retorting, carbonaceous material in the oil shale is ignited by any known method as, for example, the method described in the aforementioned U.S. Pat. No. 3,661,423 or U.S. Pat. Application Ser. No. 772,760, filed Feb. 28, 1977 by me, and assigned to the assignee of this invention, and incorporated herein by this reference. In establishing a primary combustion zone by the method described in the aforementioned application, a combustible gaseous mixture is introduced into the retort through the conduit 16 and ignited. Retort off gas is withdrawn through the drift 18, thereby bringing about a movement of gas from top to bottom of the retort through the fragmented permeable mass of particles containing oil shale. The combustible gaseous mixture contains an oxgyen supplying gas such as air and a fuel such as propane, butane, shale oil, natural gas, or the like. The supply of the combustible gaseous mixture to the primary combustion zone is maintained for a period sufficient for oil shale in the fragmented mass near the upper boundary of the retort to become heated to a temperature higher than the spontaneous ignition temperature of carbonaceous materials in the shale, and generally higher than about 900° F, so that the combustion zone can be sustained by the introduction of oxygen supplying gas without fuel. At a temperature higher than about 900° F, gases passing through the primary combustion zone and the combustion gas are at a sufficiently high temperature to rapidly retort oil shale on the advancing side of the combustion zone. The period of establishing a self-sustaining primary combustion zone can be from about one day to about a week in duration. When a self-sustaining primary combustion zone has been formed, the retort off gas has little or no oxygen content because oxygen in the combustible gaseous mixture is depleted as the combustible gaseous mixture passes through the primary combustion zone.

After a self-sustaining primary combustion zone is formed, the retort inlet mixture 13 is introduced into the retort on the trailing side of the primary combustion zone. The retort inlet mixture contains liquid water, at least sufficient fuel to vaporize the water, and sufficient oxygen to oxidize the fuel for vaporizing the water and to form a gaseous combustion zone feed containing water vapor and oxygen. The inlet mixture has a spontaneous ignition temperature less than the temperature in the combustion zone, and preferably less than the temperature where it is introduced to the fragmented mass.

As used herein, the spontaneous ignition temperature of the fuel or the retort inlet mixture refers to the spontaneous ignition temperature at the conditions in the retort. The spontaneous ignition temperature of the fuel and the retort inlet mixture is dependent upon the conditions at which the formation particles in the retort are contacted by the fuel, i.e. the spontaneous ignition temperature of the fuel and the retort inlet mixture are dependent upon such process parameters as the total pressure in the retort and the partial pressure of oxygen in the retort.

The fuel in the retort inlet mixture is oxidized by oxygen in the inlet mixture with resultant liberation of heat which vaporizes water in the retort inlet mixture. The resultant gaseous mixture forms the combustion zone feed and contains oxidation products of the fuel such as carbon dioxide and water vapor, water vapor resulting from vaporization of the liquid water in the retort inlet mixture, nonreactive components of the source of oxygen such as nitrogen when air is the source of oxygen, and oxygen contained in the retort inlet mixture beyond that required for oxidation of the fuel.

The portion of the retort where the fuel in the retort inlet mixture is burned is referred to herein as the secondary combustion zone. As shown in the Drawing, it is on the trailing side of the primary combustion zone. The temperature of the secondary combustion zone is maintained at a temperature higher than the boiling point of water so liquid water introduced to the retort in the retort inlet mixture is vaporized in the secondary combustion zone. The temperature of the secondary combustion zone also is maintained at a temperature greater than the spontaneous ignition temperature of the retort inlet mixture. Preferably the secondary combustion zone is maintained at a temperature sufficient to maintain the temperature of the retort walls adjacent the secondary combustion zone at a temperature greater than the retorting temperature of oil shale. By maintaining the retort walls adjacent the secondary combustion zone at elevated temperatures, heat is transferred by conduction into the retort walls for recovery of hydrocarbon values from kerogen in the retort walls which otherwise might not be recovered. Preferably, the walls are maintained at a temperature greater than about 900° F to obtain recovery of hydrocarbon values from kerogen in the retort walls, more preferably greater than about 1000° F for a high rate of conduction of heat into the walls, and it is particularly preferred to maintain the retort walls adjacent the secondary combustion zone at a temperature higher than about 1200° F for a maximum recovery of hydrocarbon products from oil shale in the walls 34 of the retort.

Preferably the liquid water of the retort inlet mixture is introduced directly into the secondary combustion zone for vaporization to avoid loss of water by absorption in the fragmented permeable mass. When water is introduced to the top of the fragmented permeable mass and allowed to percolate downwardly into a secondary combustion zone, significant quantities of water can be absorbed by combusted oil shale on the trailing side of the primary combustion zone. By introducing the liquid water directly into the secondary combustion zone, this problem can be avoided.

The secondary combustion zone is in a portion or region of the retort having a temperature greater than or equal to the spontaneous ignition temperature of the fuel of the retort inlet mixture. As shown in the Drawing, preferably the secondary combustion zone is maintained in a top portion or region of the fragmented permeable mass in the retort near the inlet to the fragmented mass for two reasons. First, liquid water introduced to the top of the fragmented permeable mass in the retort has only a small distance to travel through the mass before reaching the secondary combustion zone, and therefore is less likely to be absorbed by oil shale on the trailing side of the secondary combustion zone. Second, oil shale on the trailing side of the primary combustion zone and oil shale in the retort walls on the trailing side of the primary combustion zone are maintained at an elevated temperature due to flowing gasses passing from the secondary combustion zone to the primary combustion zone. The closer the secondary combustion zone is to the top of the fragmented mass, the greater the amount of oil shale in the fragmented mass and oil shale in the walls of the retort maintained at an elevated temperature. At an elevated temperature, any residual carbonaceous material in the oil shale on the trailing side of the primary combustion zone can react with oxygen in the primary combustion zone feed and kerogen in the retort walls can be retorted. Thus, enhanced yields of hydrocarbon products can be obtained because residual carbonaceous material which otherwise might not have reacted with oxygen is used to produce the energy required for retorting, thereby allowing kerogen in the retorting zone to be retorted rather than being oxidized to generate energy required for retorting. Also contributing to enhanced yields is that kerogen in the retort walls which otherwise might not have been retorted is used to produce hydrocarbon products.

To cause the primary combustion zone to advance through the retort, the rate of introduction of the retort inlet mixture into the retort is at least sufficient to generate combustion zone feed at a superficial volumetric rate of 0.1 SCFM per square foot of cross-sectional area of the fragmented permeable mass being retorted. Preferably the primary combustion zone advances through the fragmented mass at a rate of at least about 0.5 foot per day to produce hydrocarbon products at a sufficiently fast rate to justify the capital investment required for retorting oil shale. At higher rates of advancement of the primary combustion zone, hydrocarbon yield per ton of oil shale being retorted can be adversely affected due to oxidation of hydrocarbon products. Therefore, preferably the primary combustion zone is advanced through the fragmented mass at a rate up to about 2 feet per day to avoid significant yield losses. To cause the primary combustion zone to advance through the retort at an economical rate of about 0.5 to 2 feet per day, depending on the kerogen content of the oil shale through which the primary combustion zone is advancing, the retort inlet mixture is introduced into the retort at a rate sufficient to generate from about 0.5 to about 1 SCFM of combustion zone feed per square foot of cross-sectional area of the fragmented permeable mass being retorted. Introduction of retort inlet mixture into the retort at a rate generating more than about 2 SCFM of combustion zone feed per square foot of cross-sectional area may result in a portion of the oxygen in the primary combustion zone feed being carried through an established or desired primary combustion zone location and into the retorting zone. In the retorting zone, such oxygen can burn hydrocarbon products and unretorted carbonaceous material in the oil shale, thereby decreasing shale oil yield. Therefore, it is preferred to introduce the retort inlet mixture into the retort at a rate sufficient to generate less than about 2 SCFM of primary gaseous combustion zone feed per square foot of cross-sectional area of the fragmented permeable mass being retorted.

Suitable oxygen supplying gases are oxygen, air, air enriched with oxygen, and air mixed with a diluent such as nitrogen or off gas from an in situ oil shale retort. For the purposes of this application, water is not considered to be a source of oxygen.

As a higher concentration of oxygen is introduced into the combustion zone, more heat is generated and the retorting zone advances through the retort faster. The oxygen concentration of the gaseous primary combustion zone feed is greater than about 1% by volume of the combustion zone feed to maintain a commercially acceptable advancement rate of the retorting zone. Therefore, sufficient oxygen is provided in the retort inlet mixture to oxidize the fuel in the inlet mixture and produce a gaseous primary combustion zone feed which contains at least 1% oxygen by volume. At an oxygen concentration greater than about 20% by volume of the primary combustion zone feed, contact of the primary combustion zone feed with regions of high concentration of carbonaceous materials in the retort can cause some localized fusion of the fragmented mass of oil shale particles. Fusion of the fragmented mass can restrict the movement of the primary combustion zone feed through the retort. Therefore, it is preferred to use a retort inlet mixture having sufficient oxygen to form a gaseous primary combustion zone feed having from about 'to about 20% oxygen by volume.

Maintenance of the oxygen concentration at less than about 15% by volume of the gaseous primary combustion zone feed provides a margin of safety to prevent fusion of the mass of oil shale particles. At an oxygen concentration of at least about 10% by volume of the primary combustion zone feed, the maximum temperature in the primary combustion zone can readily be maintained at a desired temperature above the retorting temperature of the oil shale. Therefore, the use of a retort inlet mixture containing sufficient oxygen to form a gaseous primary combustion zone feed having from about 10 to about 15% oxygen by volume constitutes a particularly preferred version of this invention.

The concentration of oxygen in the retort inlet mixture depends upon such factors as the volume of primary combustion zone feed desired to be generated per square foot of cross-sectional area of the fragmented permeable mass being retorted, desired temperature in the primary combustion zone, and the amount of residual carbonaceous material left in the shale after retorting. A lower concentration of oxygen is needed in the retort inlet mixture as the volumetric flow rate of the primary combustion zone feed increases, as the desired temperature in the primary combustion zone decreases, and/or as the concentration of residual carbonaceous material in the retorted oil shale increases. Conversely, a higher concentration of oxygen is required in the retort inlet mixture at lower volumetric rates of the gaseous primary combustion zone feed, higher desired primary combustion zone temperatures, and/or lower concentrations of residual carbonaceous material.

Beneficial effects, as described below, are obtained from the presence of water vapor in the combustion zone feed, even at low concentrations of water. To obtain significant beneficial effects of the presence of water vapor in the gaseous combustion zone feed, preferably there is sufficient water in the retort inlet mixture that a combustion zone feed is formed containing at least about 10% by volume of water vapor. In forming the retort inlet mixture, allowance should be made for water resulting from oxidation of any hydrogen containing compounds present in the fuel and leakage of water into the retort from underground aquifers.

The higher the water vapor concentration of the primary combustion zone feed, the greater the benefits obtained from the presence of the water vapor. However, since preferably there is at least about 10% oxygen by volume in the primary combustion zone feed and the primary combustion zone feed also contains combustion products of the fuel, the amount of water vapor in the primary combustion zone feed is generally less than about 90% by volume. Preferably air is the source of oxygen. Because of nonreactive components of air such as nitrogen, when there is 10% or more oxygen by volume in the primary combustion zone feed, the maximum concentration of water vapor obtainable in the primary combustion zone feed when air is used as the source of oxygen for the retort inlet mixture is about 50% by volume.

The water in the retort inlet mixture can be a portion of the water withdrawn from the sump at the bottom of an in situ oil shale retort. This is an advantageous use of such water since it can contain some hydrocarbon products of retorting and inorganic materials and therefore could require treatment before release to the environment. When such water is used in the process, treatment is not required and the amount of fuel introduced into the retort as part of the inlet mixture for vaporization of the water can be reduced. Water containing impurities from other sources such as boiler blow down and sewage can be used as the source of water.

The water can be introduced into the retort by such techniques as spraying or atomizing the water into the gaseous source of oxygen, emulsifying the water with the fuel when a liquid fuel is used, or forming a solution of the water with the fuel when the fuel is alcohol or other water soluble fuel.

The fuel can be a gaseous fuel such as propane, butane, natural gas or the like; a liquid fuel such as diesel fuel, shale oil, or the like; or comminuted solid fuel such as coal; or mixtures thereof. Preferably, a portion of the liquid hydrocarbon products withdrawn from an oil shale retort is used for supplying at least a portion of the fuel of the inlet mixture since it is readily available at the retort site and does not have any value added from processing.

Exemplary of suitable retort inlet mixtures is one containing about 7,900 SCFM (standard cubic feet per minute) air, about 3.5 gallons per minute of water, and about 77 SCFM of fuel gas having a heating value of 2,300 BUT/SCF. This retort inlet mixture forms by oxidation of the fuel gas and resultant vaporization of the water, a combustion zone feed containing about 14.7% by volume of oxygen and about 10.2% by volume water vapor, with the remainder comprising principally combustion products of the fuel gas and nonreactive components of the air. This retort inlet mixture produces 0.62 SCFM of combustion zone feed per square foot of retort cross-sectional area for a retort 118 feet square.

Also exemplary of suitable retort inlet mixtures is one containing about 7,900 SCFM of air, about 3.5 gallons/minute water, and about 1.3 gallons/minute of shale oil having a density of about 7.529 lbs./gallon and a net heating value of about 17,500 BTU/lb. The shale oil is produced by in situ retorting of oil shale. The combustion zone feed formed from this retort inlet mixture contains about 14.7% by volume oxygen and about 10.2% by volume water vapor, with the remainder comprising principally combustion products of the shale oil and nonreactive components of the air. This retort inlet mixture produces 0.62 SCFM of combustion zone feed per square foot of retort cross-sectional area for a retort 118 feet square.

The fuel and the oxygen supplying gas preferably are substantially homogeneously mixed prior to introduction into the retort so that the mixture can spontaneously ignite when it reaches an adequate temperature. This can be accomplished by any of a number of methods. For example, when the fuel is a liquid fuel, the fuel can be dispersed in the oxygen supplying gas by means of a venturi gas/liquid contactor or similar device. When the fuel is a gaseous fuel, the oxygen and gas can be mixed by means of an injection nozzle.

Gaseous combustion zone feed formed from the retort inlet mixture is introduced into the primary combustion zone at a rate sufficient to maintain the maximum temperature in the combustion zone at a temperature above the retorting temperature of the oil shale and to advance the primary combustion zone through the in situ oil shale retort. In the primary combustion zone, residual carbonaceous material in the retorted oil shale is believed to combine with oxygen in the primary combustion zone feed according to the reactions:

$$C + O_2 \rightarrow CO_2 \quad (1)$$

$$C + CO_2 \rightarrow 2CO \quad (2)$$

and $$2CO + O_2 \rightarrow 2CO_2 \quad (3)$$

Reactions (1) and (3), which are exothermic, generate heat required for the endothermic retorting of kerogen in the oil shale in the retorting zone. Carbon dioxide produced by carbonate decomposition within an oil shale particle can react with residual carbonaceous material contained therein by reaction (2). Also, carbon dioxide genrated by oxidation of fuel in the secondary combustion zone can react with residual carbonaceous material contained in oil shale particles by reaction (2).

If carbonaceous material in the retort is at a sufficiently high temperature, water vapor can react by the water gas reaction:

$$H_2O + C \rightarrow H_2 + CO \quad (4)$$

or by its equivalent:

$$n\,H_2O + C_nH_{n+2} \rightarrow (3n+1/2)H_2 + nCO \quad (5)$$

The water gas reaction is believed to occur when water contacts carbonaceous material heated to a temperature above about 1200° F. It is though that the residual carbonaceous material remaining in retorted oil shale is in a highly active form and the water gas reaction can occur at a temperature from about 1000° to 1100° F.

Carbon monoxide generated by the water gas reaction can be oxidized by oxygen in the combustion zone feed according to reaction (3) and hydrogen generated by the water gas reaction can be oxidized according to the reaction:

$$2H_2 + O_2 \rightarrow 2H_2O. \quad (6)$$

Although the water gas reaction is endothermic, reactions (1), (3), and (6) are exothermic. The net result of reactions (3), (4) and (6) is the oxidation of carbon to carbon dioxide with regeneration of the water used in the water gas reaction by reaction (6).

The upper limit on the temperature in the primary and secondary combustion zones is determined by the fusion temperature of the oil shale, which is about 2100° F. The temperature in the primary and secondary combustion zones preferably is maintained below about 1800° F to provide a margin of safety between the temperature in the combustion zone and the fusion temperature of the oil shale. In this specification, when the temperature of a combustion zone is mentioned, reference is being made to the maximum temperature in the combustion zone.

Retorting of oil shale can be carried out with primary combustion zone temperatures as low as about 800° F. However, in order to have retorting at an economically fast rate, it is preferred to maintain the primary combustion zone at least at about 900° F. Preferably the combustion zone is maintained at a temperature of at least about 1100° F to obtain advantages resulting from reaction between water and carbonaceous residue in retorted oil shale according to the water gas reaction.

Oil shale is a poor heat conductor, and therefore, heat generated in a zone in an in situ oil shale retort tends to remain within the zone and increase the temperature of oil shale within the zone. However, with the method described herein, gases are moved through the primary combustion zone in the direction of advancement of the primary combustion zone through the retort. The gaseous mixture passing from the primary combustion zone into the retorting zone contains combustion gas generated in the primary combustion zone and any unreacted portion of the retort inlet mixture. This gas stream provides the heat required for the endothermic retorting of the kerogen in the oil shale particles.

Retorting of the oil shale in the retorting zone produces gaseous and liquid products such as carbon dioxide, carbon monoxide, hydrogen, hydrogen sulfide, water liberated from the shale, and hydrocarbons. Unretorted oil shale on the advancing side of the retorting zone is at the ambient temperature of the oil shale prior to establishing the combustion zone in the retort, and is below the dew point of gas on the advancing side of the retorting zone. Thus, water introduced into the retort as part of the retort feed mixture, water produced by combustion of the fuel, and any water released from the oil shale can condense on unretorted oil shale. Such condensed water percolates to the bottom of the fragmented mass and is collected in the sump 20 as a portion of the liquid products. Also collected in the sump are hydrocarbons produced in the retorting zone which condense above ambient temperatures. The uncondensed gaseous products, combustion gas from the combustion zone, carbon dioxide from carbonate decomposition, and any gaseous unreacted portion of the retort inlet mixture are withdrawn from the retort through the drift 18 in the off gas stream 22. The off gas stream can be saturated with water vapor.

A method of in situ retorting wherein the inlet mixture includes water has significant advantages compared to a method of retorting oil shale where the oxygen supplying gas is diluted with recycled off gas. Among these advantages is increased yield of liquid hydrocarbon products. It is believed that this improved yield is at least partially attributable to higher diffusivity of water vapor through oil shale as compared to the diffusivity of oxygen through oil shale. Because water vapor has higher diffusivity, water is able to react with residual carbonaceous material in the internal portions of large shale particles and in unfragmented shale along the boundaries of the retort which otherwise would not be reached by oxygen or would be reached at a much later time. Thus the heating value of residual carbonaceous material which would otherwise go unrecovered is obtained for use in retorting additional hydrocarbon product.

It also is believed that the presence of water improves hydrocarbon yields by widening the retorting zone. It has been calculated that when at least about 10% water vapor by volume is included in the combustion zone feed, there is an increase of about 50% in width of a zone having a temperature of 400° F at its leading edge and about 700° F at its trailing edge. This is believed to be the result of the high heat capacity of water vapor compared to the heat capacity of combustion gas generated in the primary combustion zone. Because water vapor has a higher heat capacity it can carry more heat per unit volume from the primary combustion zone to the oil shale in the retorting zone than the combustion gas. Thus, for a given primary combustion zone temperature and fixed rate of flow of gaseous primary combustion zone feed, more thermal energy passes from the primary combustion zone to the retorting zone as the proportion or concentration of water vapor in the gases increases, thereby resulting in a wider retorting zone. Also, carbon dioxide has a higher heat capacity than oxygen and nitrogen. Thus it is believed that the high heat capacity of carbon dioxide generated in the secondary combustion zone also results in a wider retorting zone.

It is believed a wider retorting zone contributes to increased yields for three reasons. First, because of the wider retorting zone, there is less chance that oxygen present in the combustion zone can reach the portion of the retorting zone where the bulk of the hydrocarbon products are producted to oxidize these products. Second, it is believed that less cracking of the hydrocarbon products is experienced with a wider retorting zone because of less commingling of the retorting and primary combustion zones. Third, because of a wider retorting zone, the oil shale can be maintained at retorting temperature for a longer period of time, thereby allowing more hydrocarbons to be produced from the kerogen.

Also contributing to enhanced yields is that the primary combustion zone feed can contain much higher concentrations of water vapor than of oxygen because even at high concentrations of water vapor in the combustion zone feed, fusion of the mass of fragmented oil shale particles does not occur. At high oxygen concentrations such fusion can occur. A high concentration of a gas such as water vapor or oxygen which is reactive with residual carbonaceous material in the primary combustion zone feed is desirable because the rate of diffusion of a gas into oil shale is dependent on the concentration of the gas. Thus at very high concentrations of water vapor, which cannot be achieved with oxygen due to the problem of fusion, penetration into even the larger fragmented oil shale particles occurs. Therefore the heating value of the residual carbonaceous material contained therein is recovered and enhanced yields are obtained.

Furthermore, a portion of the heat required for retorting oil shale in the retorting zone can be obtained from combustion of the fuel introduced in the inlet mixture if excess fuel beyond the amount required for vaporization of water in the retort inlet mixture is introduced to the retort. Thus, less heat needs to be generated in the primary combustion zone and less oxygen needs to be introduced into the primary combustion zone compared to when the retort inlet mixture contains no fuel. Therefore, improved yields are obtained because there is less chance for oxygen to infiltrate the retorting zone and combine therein with hydrocarbon products of retorting.

Another advantage of retorting with a retort inlet mixture comprising water, fuel, and oxygen is enhancement of the fuel value of the retort off gas. In retorting operations utilizing a gaseous feed comprising air and recycled retort off gas, the heating value of the retort off gas is relatively low, i.e., in the order of about 20 to 60 BTU/SCF on a dry basis. Such retort off gas is of marginal value, if usable at all, for use in a work engine to generate power, and if it is used, it may be necessary to augment the retort off gas with other combustible material. It is found that when the combustion zone feed contains water vapor, an off gas with a heating value of from about 50 to about 100 BTU/SCF or higher can be obtained. At such heating value the off gas is satisfactory for combustion in a work engine such as the gas turbine 26. Relatively high heating value off gas can be used as at least part of the fuel of the retort inlet mixture. It is believed that this improvement in the heating value of the off gas is attributable to two factors. First, water vapor contacting heated carbonaceous material in the retort undergoes the water gas reaction to generate carbon monoxide and hydrogen which enhance the heating value of the off gas. Second, when air is a source of oxygen and water vapor is used as a diluent for the combustion zone feed, the bulk of the water vapor does not appear in the off gas from the retort, but instead is condensed on the shale on the advancing side of the retorting zone and is withdrawn as liquid with the condensed hydrocarbon product. Condensation of the water vapor removes an inert diluent from the off gas, enhancing its fuel value on a volumetric dry basis. This is unlike the case where recycled off gas is used as the diluent of the feed mixture, since the nonreactive portion of the recycled off gas appears in the off gas withdrawn from the retort.

Another advantage of the method of this invention is minimization of water usage. Compared to methods where no fuel is provided for vaporization of liquid water and thus liquid water can be absorbed by retorted oil shale as the water passes through the fragmented mass on the trailing side of the primary combustion zone, less water is consumed during the retorting operation. Water is a valuable commodity in the western portion of the United States where the bulk of oil shale reserves are located, and thus recovery of water introduced into the retort is important. Compared to methods where steam is used as a diluent for the source of oxygen in the retort inlet mixture, the method of this invention does not require a costly steam plant.

Advantages of providing a retort inlet mixture containing water vapor and oxygen are discussed in the aforementioned U.S. application Ser. No. 615,558 filed Sept. 22, 1975, now U.S. Pat. No. 4,036,299.

Advantages of providing a retort inlet mixture containing fuel are described in the aforementioned patent application Ser. No. 728,911, filed on Oct. 4, 1976, which is the parent application of this patent application. Such advantages include establishment of a secondary combustion zone in the retort. The presence of a secondary combustion zone in the retort can result in enhancement of the fuel value of the retort off gas, increased recovery of hydrocarbon products from unfragmented formation adjacent the retort, and increased recovery of hydrocarbon products from the fragmented mass of particles in the retort.

Advantages of the present invention are demonstrated by the following control and example.

CONTROL

Retort inlet mixture at a rate of about 1050 SCFM was formed by diluting air to a concentration of about 13% oxygen with recycled off gas from an active in situ oil shale retort in the south/southwest portion of the Piceance Creek structural basin in Colorado. The cross-sectional area of the fragmented permeable mass of particles containing oil shale being retorted in the retort was about 1050 square feet and the retort was about 110 feet high. It is believed that the retort contained a fragmented permeable mass comparable to that of the retort described above, i.e., the fragmented mass consisted of about 58% by weight particles having a weight average diameter of 2 inches, about 23% by weight particles having a weight average diameter of 8 inches, and about 19% by weight particles having a weight average diameter of 30 inches. The superficial volumetric rate of the combustion zone feed was just less than 1 SCFM per square foot of cross-sectional area of the fragmented permeable mass being retorted. Off gas obtained from the retort and which was used to dilute the air had a heating value of 63 BTU/SCF on a dry basis and 155 barrels per day of shale oil were recovered.

EXAMPLE

Using the same retort used for the control, a retort inlet mixture was formed containing 10 SCFM of fuel gas having a net heating value of about 2300 BTU/SCFM, about 880 SCFM of air and about 1 GPM of water. The retort inlet mixture, which had a spontaneous ignition temperature of about 900° F, was introduced into the retort on the trailing side of the primary combustion zone which had a temperature of about 1200° F. Due to the spontaneous ignition of the retort inlet mixture, about 1050 SCFM (same as control) of gaseous combustion zone feed was formed having an oxygen content of about 13% by volume (same as control) and water vapor content of about 21% by volume. The off gas withdrawn from the retort had a heating value of about 78 BTU/SCF on a dry basis and shale oil was produced at a rate of about 320 barrels per day. This represents a 24% increase in the heating value of the off gas and over a 100% improvement in the rate of recovery of shale oil compared to the control. It is possible that the improvement in the heating value of the off gas and rate of recovery of shale oil were partly due to a higher grade oil shale being retorted for the Example than for the Control.

Tests conducted with a laboratory scale retort containing $-\frac{1}{4}+\frac{1}{8}$ inch oil shale particles resulted in lower liquid hydrocarbon yield when a mixture of steam and air containing about 13% oxygen was introduced into the retort than when a mixture of recycled off gas and air containing about 13% oxygen was introduced into the retort. The lower liquid hydrocarbon yield with a mixture of steam and air was different from results obtained in field tests with an in situ oil shale retort as described in the above Example. It is believed the difference in liquid hydrocarbon yield results from differences in oil shale particle size between the in situ retort and the laboratory retort. The heating value of the off gas from the laboratory retort was higher when a mixture of steam and air was introduced into the retort than when a mixture of recycled off gas and air was introduced into the retort. The higher heating value of the off gas with a mixture of steam and air was the same as results obtained in field tests.

Although this invention has been described in considerable detail with reference to certain versions thereof, other versions are within the scope of this invention. For example, although the invention has been described in terms of a single in situ oil shale retort containing both a combustion zone and a retorting zone, it is possible to practice this invention with two serially connected retorts. The first retort would contain retorted oil shale and the combustion zone. The gases generated in the combustion zone of the first retort would be passed to a second retort for retorting raw oil shale contained therein.

In addition, although the drawing shows a retort where the combustion and retorting zones are advancing downwardly through the retort, this invention is also useful for retorts where the combustion and retorting zones are advancing upwardly or transverse to the vertical.

Furthermore, although the invention has been described with the water, source of oxygen, and fuel comprising the retort inlet mixture being introduced together and continuously into a retort, these three components of the inlet mixture can be introduced intermittently and/or independently into the retort.

Because of variations such as these, the spirit and scope of the appended claims should not necessarily be limited to the description of the preferred versions contained herein.

What is claimed is:

1. A method for recovering liquid and gaseous products from an in situ oil shale retort in a subterranean formation containing oil shale, said in situ retort containing a fragmented permeable mass of formation particles containing oil shale, said in situ retort having a combustion zone and a retorting zone advancing therethrough, which comprises the steps of:

(a) introducing into the in situ oil shale retort on the trailing side of the combustion zone a retort inlet mixture comprising liquid water, at least sufficient fuel to vaporize the water, and sufficient oxygen to oxidize the fuel for vaporizing the water and to form a gaseous combustion zone feed containing water vapor and oxygen, the retort inlet mixture having a spontaneous ignition temperature less than the temperature of the combustion zone;

(b) introducing the combustion zone feed into the combustion zone to advance the combustion zone through the fragmented mass of particles and produce combustion gas in the combustion zone;

(c) passing said combustion gas and any gaseous unreacted portion of the combustion zone feed through the retorting zone in the fragmented mass of particles on the advancing side of the combustion zone wherein oil shale is retorted and gaseous and liquid products are produced; and (d) withdrawing liquid products and retort off gas comprising said gaseous products, combustion gas and any gaseous unreacted portion of the retort inlet mixture from the in situ oil shale retort from the advancing side of the retorting zone.

2. A method as claimed in claim 1 in which the fuel of the retort inlet mixture comprises a hydrocarbon product withdrawn from such an in situ oil shale retort.

3. A method as claimed in claim 1 in which the water of the retort inlet mixture comprises water withdrawn from such an in situ oil shale retort.

4. A method as claimed in claim 1 in which the water and fuel of the retort inlet mixture comprise water and a liquid hydrocarbon product withdrawn from such an in situ oil shale retort.

5. A method as claimed in claim 1 in which the retort inlet mixture is introduced into the retort at a sufficient rate to form from about 0.1 to about 2 standard cubic feet of gaseous combustion zone feed per minute per square foot of cross-sectional area of the fragmented permeable mass being retorted.

6. A method as claimed in claim 1 in which the retort inlet mixture is introduced into the retort at a sufficient rate to form from about 0.5 to about 1 standard cubic foot of gaseous combustion zone feed per minute per square foot of cross-sectional area of the fragmented permeable mass being retorted.

7. A method as claimed in claim 1 in which the gaseous combustion zone feed contains less than about 20% oxygen by volume.

8. A method as claimed in claim 1 in which the retort inlet mixture contains sufficient oxygen that the gaseous combustion zone feed contains from about 10 to about 15% oxygen by volume.

9. A method as claimed in claim 1 in which the retort inlet mixture contains sufficient water that the gaseous combustion zone feed contains from about 10 to about 50% water vapor by volume.

10. A method as claimed in claim 1 in which the retort inlet mixture contains sufficient water that the gaseous combustion zone feed contains from about 20 to about 40% water vapor by volume.

11. The method of claim 1 in which the combustion zone is maintained at a temperature of from about 900° F to about 1800° F.

12. The method of claim 1 wherein the retort inlet mixture has a spontaneous ignition temperature equal to or less than the temperature of a region of the fragmented mass on the trailing side of the combustion zone.

13. In a method for advancing a combustion zone through an in situ oil shale retort in a subterranean formation containing oil shale, said in situ retort containing a fragmented permeable mass of particles containing oil shale, the improvement comprising the steps of:

(a) introducing into the in situ oil shale retort on the trailing side of the combustion zone an inlet mixture comprising liquid water, at least sufficient fuel to vaporize the water, and sufficient oxygen to oxidize the fuel for vaporizing the water and to form a gaseous combustion zone feed containing water vapor and oxygen; and (b) introducing the combustion zone feed into the combustion zone to advance the combustion zone through the fragmented mass of particles and produce combustion gas in the combustion zone.

14. The method of claim 13 in which the inlet mixture contains sufficient oxygen that the combustion zone feed contains up to about 20% oxygen by volume.

15. A method as claimed in claim 13 in which the inlet mixture contains sufficient water that the gaseous combustion zone feed contains from about 20 to about 40% water vapor by volume.

16. The method of claim 13 wherein the water introduced into the retort comprises water from such an in situ oil shale retort.

17. The method of claim 16 wherein the water contains hydrocarbon products from such an in situ oil shale retort.

18. The method of claim 16 wherein the fuel introduced into the retort comprises hydrocarbon product from such an in situ oil shale retort.

19. A method for recovering liquid and gaseous products from a first in situ oil shale retort in a subterranean formation containing oil shale, said first in situ retort containing a fragmented permeable mass of particles containing oil shale, said first in situ retort having a retorting zone advancing therethrough, which comprises the steps of:

(a) introducing a retort inlet mixture comprising liquid water, at least sufficient fuel to vaporize the water, and sufficient oxygen to oxidize the fuel for vaporizing the water and to form a gaseous combustion zone feed containing water vapor and oxygen into a second in situ oil shale retort in a subterranean formation containing oil shale, said second in situ retort containing a fragmented permeable mass of particles containing oil shale, said second in situ retort having a combustion zone advancing therethrough, wherein said inlet mixture is introduced on the trailing side of the combustion zone and has a spontaneous ignition temperature less than the temperature of the combustion zone;

(b) introducing the gaseous combustion zone feed into the combustion zone to advance the combustion zone through the fragmented mass of particles and producing combustion gas in the combustion zone;

(c) passing said combustion gas and any gaseous unreacted portion of the combustion zone feed from the second in situ oil shale retort into the retorting zone in the first in situ oil shale retort wherein oil shale is retorted to produce gaseous and liquid products; and (d) withdrawing liquid products and retort off gas comprising said gaseous products, combustion gas and any gaseous unreacted portion of the combustion zone feed from the advancing side of the retorting zone.

20. A method as claimed in claim 19 in which the fuel of the retort inlet mixture comprises hydrocarbon product withdrawn from the first in situ oil shale retort.

21. A method as claimed in claim 19 in which water of the retort inlet mixture comprises water withdrawn from the first in situ oil shale retort.

22. A method as claimed in claim 19 in which the water and fuel of the retort inlet mixture comprise liquid products containing water and a hydrocarbon product withdrawn from the first in situ oil shale retort.

23. A method for recovering liquid and gaseous products from an in situ oil shale retort in a subterranean formation containing oil shale, said in situ retort containing a fragmented permeable mass of particles containing oil shale, said in situ retort having a combustion zone and a retorting zone advancing therethrough, which comprises the steps of:

(a) introducing into the in situ oil shale retort on the trailing side of the combustion zone a retort inlet mixture comprising liquid water, at least sufficient fuel to vaporize the water, and sufficient oxygen to oxidize the fuel to vaporize the water and to form from about 0.5 to about 1 standard cubic foot per minute per square foot of cross-sectional area of the fragmented permeable mass being retorted of a gaseous combustion zone feed containing from about 10 to about 15% oxygen by volume and from about 20 to about 40% water vapor by volume for introduction into the combustion zone to maintain the combustion zone at a temperature of from about 900° to about 1800° F and to advance the combustion zone through the fragmented mass of particles and to produce combustion gas in the combustion zone, the retort inlet mixture having a spontaneous ignition temperature less than the temperature of the combustion zone;

(b) introducing the combustion zone feed into the combustion zone to advance the combustion zone through the fragmented mass of particles and produce combustion gas in the combustion zone;

(c) passing said combination gas and any gaseous unreacted portion of the combustion zone feed through a retorting zone in the fragmented mass of particles on the advancing side of the combustion zone wherein oil shale is retorted and gaseous and liquid products are produced; and (d) withdrawing liquid products and retort off gas comprising said gaseous products, combustion gas and any gaseous unreacted portion of the retort inlet mixture from the in situ oil shale retort from the advancing side of the retorting zone.

24. A method of introducing water vapor into a retorting zone advancing through an in situ oil shale retort containing a fragmented permeable mass of particles containing oil shale, comprising the steps of:

(a) introducing water to the retort on the trailing side of the retorting zone;

(b) introducing sufficient fuel to the retort on the trailing side of the retorting zone to supply at least enough heat to vaporize the water; and (c) introducing at least sufficient oxygen to oxidize the fuel to the retort on the trailing side of the retorting zone.

25. The method of claim 24 in which the retort contains a combustion zone advancing through the retort on the trailing side of the retorting zone, and the water, fuel, and oxygen are introduced to the retort on the trailing side of the combustion zone.

26. The method of claim 25 in which the fuel has a spontaneous ignition temperature less than the temperature of the combustion zone.

27. The method of claim 25 in which the fuel is introduced into a region of the retort having a temperature at least equal to the spontaneous ignition temperature of the fuel.

28. A method for recovering liquid and gaseous products from an in situ oil shale retort in a subterranean formation containing oil shale, said in situ retort containing a fragmented permeable mass of formation particles containing oil shale, said in situ retort having a primary combustion zone and a retorting zone advancing therethrough, which comprises the steps of:

(a) establishing a secondary combustion in the retort by introducing into the in situ oil shale retort on the trailing side of the primary combustion zone a retort inlet mixture comprising liquid water, at least sufficient fuel to vaporize the water, and sufficient oxygen to oxidize the fuel for vaporizing the water and to form a gaseous combustion zone feed containing water vapor and oxygen, the retort inlet mixture having a spontaneous ignition temperature of less than or equal to the temperature of a region of the retort on the trailing side of the primary combustion zone;

(b) introducing the combustion zone feed into the primary combustion zone to advance the primary combustion zone through the fragmented mass of particles and produce combustion gas in the primary combustion zone;

(c) passing said combustion gas and any unreacted portion of the combustion zone feed through the retorting zone in the fragmented mass of particles on the advancing side of the primary combustion zone wherein oil shale is retorted and gaseous and liquid products including water vapor are produced;

(d) condensing water vapor to liquid water in the fragmented mass of particles in the retort on the advancing side of the retorting zone; and (e) withdrawing liquid products, including liquid water and hydrocarbon products, and retort off gas comprising said gaseous products, combustion gas and any gaseous unreacted portion of the retort inlet mixture from the in situ oil shale retort from the advancing side of the retorting zone.

29. A method as claimed in claim 28 in which the fuel of the retort inlet mixture comprises a hydrocarbon product withdrawn from such an in situ oil shale retort.

30. A method as claimed in claim 28 in which the water of the retort inlet mixture comprises water withdrawn from the in situ oil shale retort.

31. A method as claimed in claim 28 in which the water and fuel of the retort inlet mixture comprise water and a liquid hydrocarbon product withdrawn from the in situ oil shale retort.

32. A method for producing water vapor in an in situ oil shale retort in a subterranean fraction containing oil shale, the in situ retort containing a fragmented permeable mass of formation particles containing oil shale, the method comprising the steps of:

(a) establishing a primary combustion zone advancing through the fragmented mass;

(b) establishing a secondary combustion zone in the retort on the trailing side of the primary combustion zone by introducing into the retort on the trailing side of the primary combustion zone at least sufficient fuel to maintain the secondary combustion zone at a temperature greater than the boiling temperature of water and sufficient oxygen to oxidize the fuel, the fuel having a spontaneous ignition temperature less than the temperature of the primary combustion zone; and (c) introducing liquid water into the secondary combustion zone.

33. The method of claim 32 in which the fuel has a spontaneous ignition temperature less than the temperature of a region of the fragmented permeable mass on the trailing side of the primary combustion zone.

34. The method of claim 32 in which the step of establishing a secondary combustion zone comprises establishing a secondary combustion zone in the top portion of the fragmented permeable mass.

35. A method for introducing water vapor into a primary combustion zone advancing through an in situ oil shale retort containing a fragmented permeable mass of particles containing oil shale, comprising the steps of:

(a) introducing liquid water into the fragmented permeable mass at a location on the trailing side of the primary combustion zone; and (b) burning fuel at a temperature greater than the boiling temperature of water in the fragmented mass adjacent the location of the introduction of water into the fragmented mass for vaporization of the introduced liquid water.

36. The method of claim 35 in which the liquid water is introduced into the fragmented mass at a location in the top portion of the fragmented permeable mass.

37. The method of claim 35 in which the fuel has a spontaneous ignition temperature less than the temperature of the primary combustion zone.

* * * * *

UNITED STATES PATENT AND TRADEMARK OFFICE

CERTIFICATE OF CORRECTION

PATENT NO. : 4,089,375

DATED : May 16, 1978

INVENTOR(S) : Chang Yul Cha

It is certified that error appears in the above-identified patent and that said Letters Patent are hereby corrected as shown below:

Column 1, line 36, "preferably" should be -- preferable --.

Column 7, line 8, after "for" and before "maximum" delete "a".

Column 8, line 57, delete " ' " before "to" and insert -- 1 --.

Column 10, line 12, "BUT" should be -- BTU --.

Column 11, line 14, "$(3_n + 1/2)$" should be -- $(\frac{3n}{2} + 1)$ --.

Column 18, line 58, "combination" should be -- combustion --.

Signed and Sealed this

*Twenty-first* Day of *November 1978*

[SEAL]

*Attest:*

RUTH C. MASON
*Attesting Officer*

DONALD W. BANNER
*Commissioner of Patents and Trademarks*